US009161673B2

(12) United States Patent
Tronconi et al.

(10) Patent No.: US 9,161,673 B2
(45) Date of Patent: Oct. 20, 2015

(54) WRINGER FOR A BUCKET

(75) Inventors: Valentina Tronconi, Milan (IT); Lloyd S. Vasilakes, Stillwater, MN (US); Edgardo Angelini, Milan (IT); Rosario D. De Salvo, Milan (IT); Sandro F. U. Pizzi, Milan (IT)

(73) Assignee: 3M Innovative Properties Company, St. Paul, MN (US)

( * ) Notice: Subject to any disclaimer, the term of this patent is extended or adjusted under 35 U.S.C. 154(b) by 531 days.

(21) Appl. No.: 13/532,979

(22) Filed: Jun. 26, 2012

(65) Prior Publication Data

US 2013/0340199 A1 Dec. 26, 2013

(51) Int. Cl.

| | |
|---|---|
| ***A47L 13/58*** | (2006.01) |
| ***A47L 13/14*** | (2006.01) |
| ***A47L 13/59*** | (2006.01) |
| ***A47L 13/24*** | (2006.01) |

(52) U.S. Cl.

CPC ..... *A47L 13/58* (2013.01); *A47L 13/14* (2013.01); *A47L 13/24* (2013.01); *A47L 13/59* (2013.01)

(58) Field of Classification Search

CPC ..... A47L 13/58; A47L 13/59; A47L 13/258; A47L 13/60; A47L 13/14; A47L 13/24; A47J 47/18

USPC ..... 15/260, 261, 263

See application file for complete search history.

(56) References Cited

U.S. PATENT DOCUMENTS

| | | | | |
|---|---|---|---|---|
| 2,079,186 | A * | 5/1937 | Schulman | 15/263 |
| 6,530,112 | B2 | 3/2003 | Hirse | |
| 6,684,450 | B2 | 2/2004 | Dingert | |
| 6,823,557 | B2 * | 11/2004 | Dingert | 15/260 |
| 2007/0094834 | A1 * | 5/2007 | Gil | 15/261 |
| 2009/0288266 | A1 | 11/2009 | Dingert et al. | |

FOREIGN PATENT DOCUMENTS

| | | |
|---|---|---|
| EP | 0489237 | 6/1992 |
| EP | 1188407 | 3/2002 |
| EP | 1210902 | 6/2002 |
| EP | 1224901 | 7/2002 |
| EP | 2068692 | 6/2009 |
| KR | 20-0269928 | 3/2002 |
| KR | 20-0393861 | 8/2005 |

OTHER PUBLICATIONS

PCT International Search Report for PCT/US2013/043380 mailed Aug. 26, 2013.

* cited by examiner

*Primary Examiner* — Robert Scruggs

(57) ABSTRACT

The disclosed wringer for a bucket includes flexible wall members for squeezing around a strip mop. Each wall member has an outer portion, an inner portion, and a transition zone between the outer portion and inner portion and each wall member having an upper face and an under face that is facing the container. On at least one of the wall members at the under face is a least one outwardly projecting rib extending through the transition zone.

11 Claims, 3 Drawing Sheets

WRINGER FOR A BUCKET

FIELD

The present disclosure relates to a wringer for a bucket. In particular, the present disclosure relates to a wringer comprising a plurality of flexible wall members.

BACKGROUND

When using a mop to clean a floor, a user will commonly use a bucket for carrying clean or dirty water to the work site. Various types of mops or cleaning systems exist to control the amount of water in the mop while cleaning. Too much water makes the floor too wet, and too little water is ineffective at wiping and removing dirt and debris from the floor. Some mops have mechanisms on the handle while some buckets have mechanisms on the bucket for releasing excess water from the mop. Butterfly or roller mops have actuators on the mop handle for squeezing the foam head of the mop. Another type of mop that is commonly used for wet cleaning is a strip mop that has a plurality of strands of absorbent material for wiping over the floor. Some strip mops have a squeezing or twisting actuator on the handle for wringing out excess water from the strands of the strip mop. Also, buckets with wringers are used to wring out excess water from the strands of the strip mop.

SUMMARY

The disclosed wringer for a bucket includes flexible wall members for squeezing around a strip mop. The flexible wall members include on at least the under face a rib which adds strength and controls flexing of the wall member.

European Patent 0489237 discloses a wringer with wall parts. The wringer in this design is extremely flexible. When a strip mop entered the wringer, the wringer was forced downward but very little lateral force was applied to squeeze the strip mop of excess water. European Patent 1188405 discloses a wringer with wall parts but also support parts. The support parts limit the extent to which the wringer can be pressed downward. European Patent 2068692 discloses a wringer with wall parts and a spacer arranged between each inner leg and each outer leg of the wall parts. The spacer is included to limit the extent to which the inner leg and outer leg can be pulled away from one another. However, the spacer is too restrictive and limits flexibility of the wringer. The disclosed wringer with the rib effectively balances flexibility of the wringer while also achieve effective lateral force during pressing.

In one embodiment, a wringing device for a container comprises a plurality of flexible wall members, each wall member having an outer portion, an inner portion, and a transition zone between the outer portion and inner portion and each wall member having an upper face and an under face that is facing the container, wherein the under face includes a least one outwardly projecting rib extending through the transition zone.

While the above-identified drawings and figures set forth embodiments of the invention, other embodiments are also contemplated, as noted in the discussion. In all cases, this disclosure presents the invention by way of representation and not limitation. It should be understood that numerous other modifications and embodiments can be devised by those skilled in the art, which fall within the scope and spirit of this invention.

The figures may not be drawn to scale.

DETAILED DESCRIPTION

Figure 1:
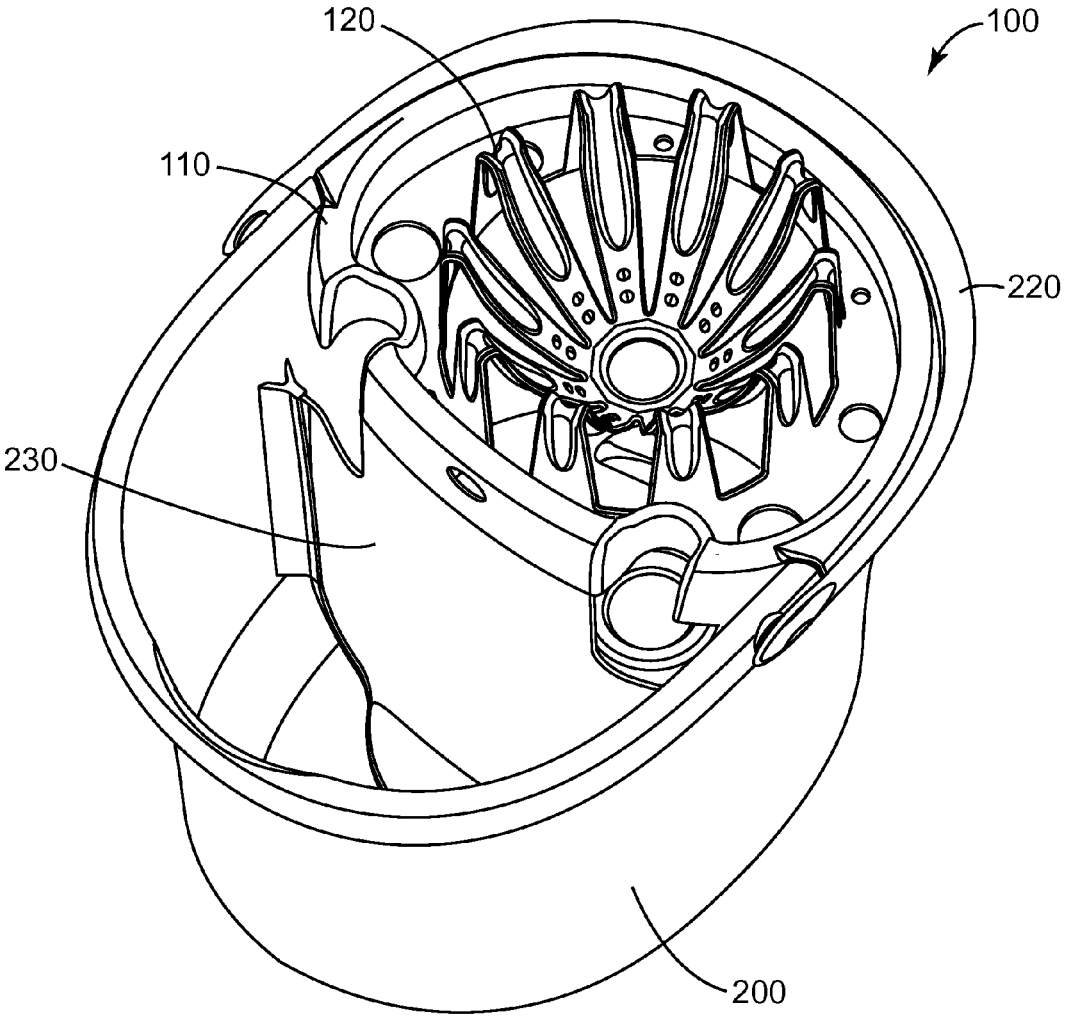
FIG. 1 is a perspective view of a wringer in a bucket.
Figure 2:
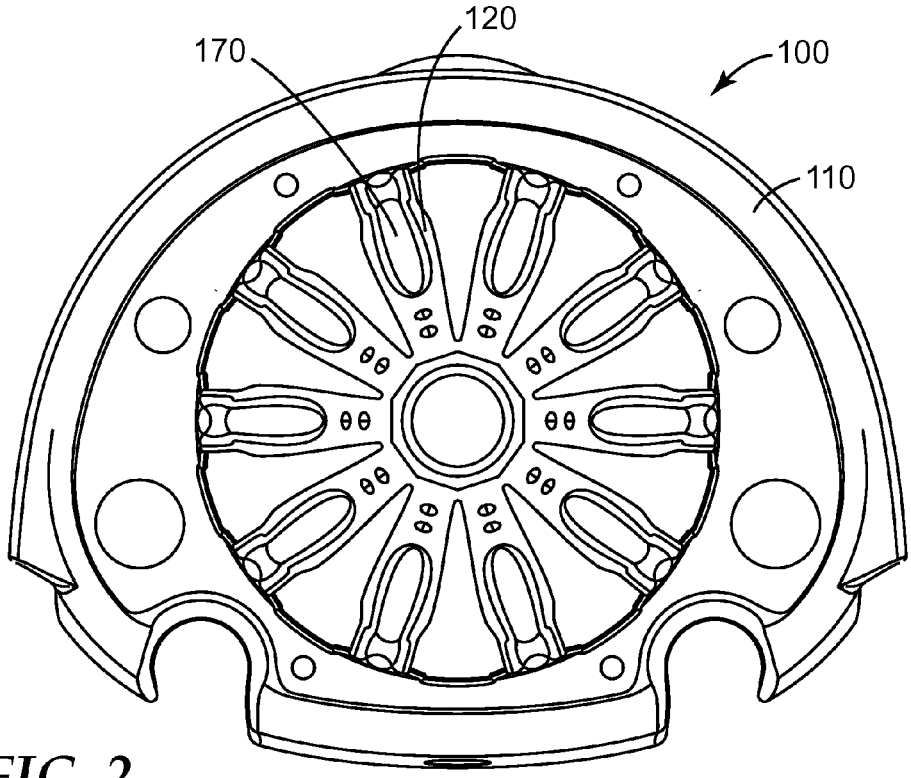
FIG. 2 is a top view of the wringer of FIG. 1.
Figure 3:
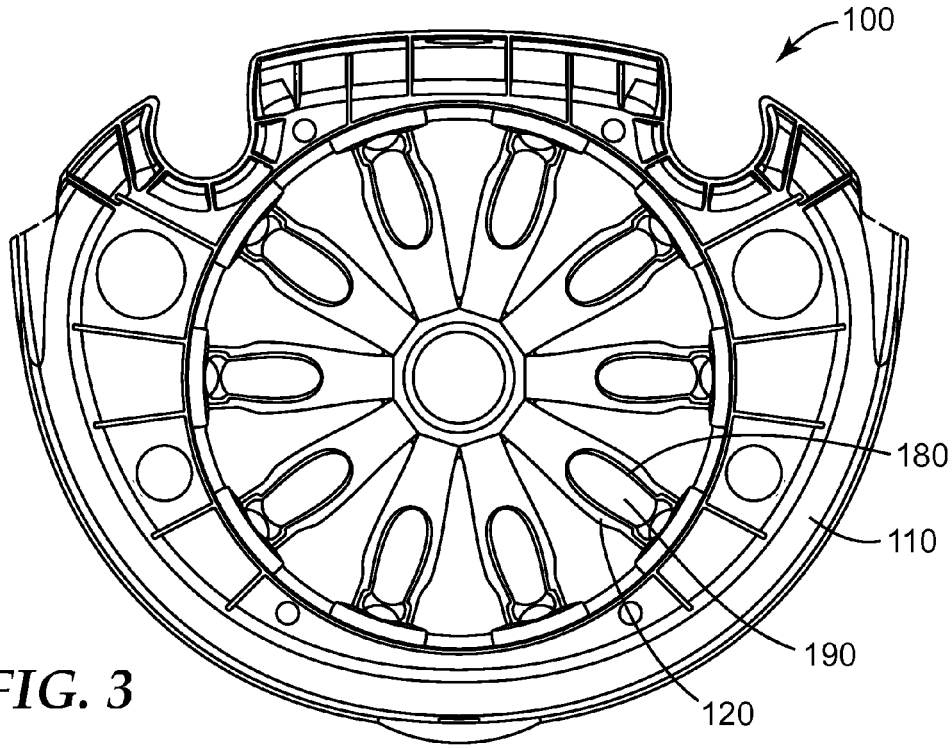
FIG. 3 is a bottom view of the wringer of FIG. 1.
Figure 4:
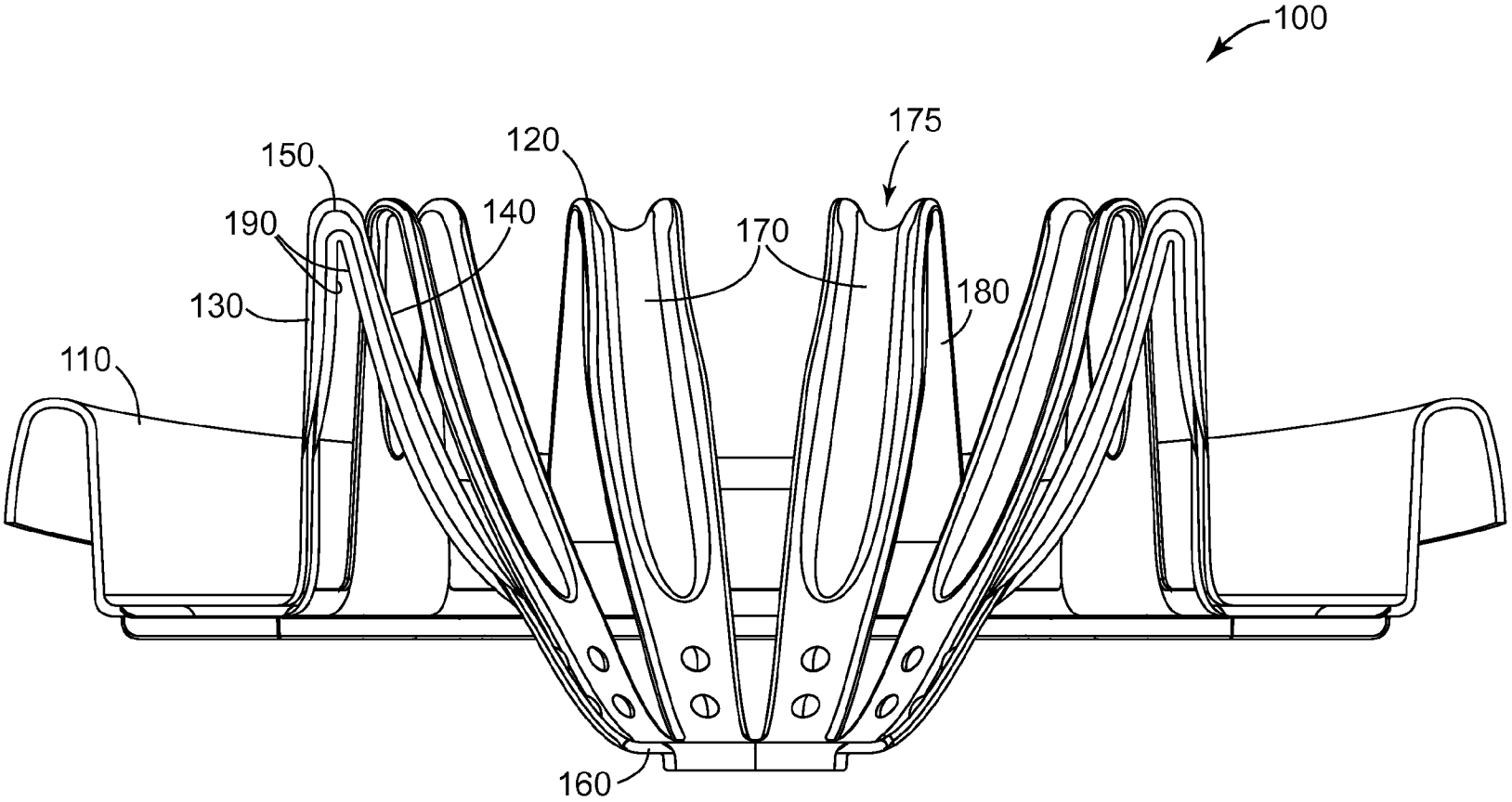
FIG. 4 is a side section of the wringer of FIG. 1.

FIG. 1 is a perspective view of a wringer 100 in a bucket 200. FIG. 2 is a top view of the wringer 100. FIG. 3 is a bottom view of the wringer 100. FIG. 4 is a side section of the wringer 100.

The wringer 100 includes a plurality of wall members 120. Each wall member 120 is spaced apart from the adjacent wall member 120 such that there is a gap between adjacent wall members 120. The spacing of the wall members 120 creates flexibility. Each wall member 120 includes an outer portion 130, an inner portion 140, and a transition zone 150 between the outer portion 130 and inner portion 140. Each wall member at the outer portion 130 is connected to a housing 110. The outer portion 130 of the wall member 120 generally extends outward from the bucket 200.

The housing 110 surrounds the wall members 120 of the wringer 100. The housing 110 may be a portion of the bucket 200 such that the wringer 100 is rigidly connected with the bucket 200. However, more commonly, the housing 110 correspondingly and removably fits with the bucket 200 such that the wringer 100 can be removed from the bucket 200.

The outer portion 130 of the wall member 120 generally extends outward from the bucket 200, as can be seen in FIG. 4. Also, the inner portion 140 of the wall member 120 generally extends outward from the bucket 200, as can be best seen in FIG. 4. However, as compared to the outer portion 130 and as can be seen in FIG. 4, the inner portion 140 is longer than the outer portion 130 and extends further inside the bucket 200. In the embodiment depicted in FIGS. 1-4, the wall members 120 at the inner portion 140 are connected to one another at a base 160. In some embodiments, for increased flexibility, the inner portions 140 of the wall members 120 can be free-hanging and disconnected from one another. In some embodiments, some of the inner portions 140 of the wall members 120 can be connected to inner portions 140 of other wall members 120, while some remain free-hanging.

Connecting the outer portion 130 to inner portion 140 of the wall member 120 is a transition zone 150. As shown in the embodiment depicted in FIGS. 1-4, the transition zone 150 comprises the peak of the wall member 120. The transition zone 150 is slightly curved. In other embodiments, the transition zone 150 could have a sharp curve, a V-shape, a U-shape, or a shape that is perpendicular to the upwardly extending outer portion 130 and inner portion 140.

In one embodiment, there are at least two wall members 120. In one embodiment, there are less than twenty wall members 120. In the embodiment shown in FIGS. 1-4, there are 10 wall members 120.

The wall member 120 has an upper face 170 and an under face 180, which is opposite the upper face 170. The under face 180 is the surface of the wall member 120 facing the interior of the bucket 200, see FIG. 3. The upper face 170 is the surface of the wall member 120 facing away from the interior of the bucket 200, see FIG. 4. In one embodiment, as shown in FIGS. 1-4, the wall member 120 extends continuously over the entire upper face 170 and under face 180 without breaks, gaps, or through cuts. In one embodiment, the upper face 170 may include protrusions to help further contact and squeeze the mop. Also, to aid in manufacturing, in the embodiment shown in FIGS. 1-4, the wall member 120 has generally continuous wall thickness.

On the under face 180 at the transition zone 150 is a rib 190. The rib 190 is an outward projection on a portion of the under face 180 of the wall member 120. At least one of the wall members 120 includes a rib. In this embodiment, there is a single rib 190. However, in other embodiments there may be one or more ribs on the under face 180. In this embodiment, the rib 190 is clearly at the transition zone 150, while also extending to a portion of the outer portion 130 and inner portion 140. As can be best seen in the embodiment in FIG. 4, the rib 190 extends to about 50% of the length of the outer portion 130 and about 50% of the length of the inner portion 140. In another embodiment, the rib 190 extends to less than 50% of the length of the outer portion 130 and to less than 50% of the length of the inner portion 140.

As shown in the embodiments in FIGS. 1-4, the wall member 120 has generally uniform thickness. Uniform wall thickness is desirable for making plastic molded parts. Therefore, in this embodiment the rib 190 at the under face 180 corresponds to a recess 175 at the upper face 170. It is understood that uniform wall thickness is not required. Therefore, in other embodiments, the shape and surface of the upper face 170 may be smooth, curved, or ribbed.

The rib 190 serves to add some rigidity to the flexing of the wall member 120 without fully restricting the extent to which the inner portion 140 moves relative to the outer portion 130. When a strip mop is pressed into the wringer 100, the wall members 120 will deform allowing the strip mop to press downward to the interior of the bucket 200. However, because of the added rigidity from the rib 190, the wall members 120 will not simply fold downward. Instead, the wall members 120 will deform up and around the top and sides of the strip mop. Unlike designs that have spacers connecting the sections of the wall members, in this embodiment, the inner portion 140 and outer portion 130 of the wall member 120 could extend away from one another, with limited restraint. Continued pressing into the wringer 100 will cause both wrapping at the top of the strip mop and squeezing on the sides of the strip mop.

The bucket 200 can be any size or shape for holding cleaning liquid. In one embodiment the bucket 200 includes a divider 230 to separate clean water from dirty water. In one embodiment, the bucket 200 includes a handle 220.

The mops used with the wringer 100 are typically strip mops that include a plurality of absorbent strips that can be made from a variety of materials such as fabric, fibers, woven, knitted, nonwoven material and may include on the strips or other portions of the mop scrubbing or scouring material.

Although specific embodiments of this invention have been shown and described herein, it is understood that these embodiments are merely illustrative of the many possible specific arrangements that can be devised in application of the principles of the invention. Numerous and varied other arrangements can be devised in accordance with these principles by those of ordinary skill in the art without departing from the spirit and scope of the invention. Thus, the scope of the present invention should not be limited to the structures described in this application, but only by the structures described by the language of the claims and the equivalents of those structures.

What is claimed is:

1. A wringing device for a container comprising:

a plurality of flexible wall members, each wall member having an outer portion, an inner portion, and a transition zone between the outer portion and inner portion and each wall member having an upper face and an under face that is facing the container;

wherein the under face of at least one of the wall members includes at least one outwardly projecting rib extending through the transition zone, wherein the rib forms a recess at the upper face.

2. The wringing device of claim 1, comprising more than 5 wall members.

3. The wringing device of claim 1, wherein the transition zone comprises the peak the wall member.

4. The wringing device of claim 1, wherein the wall member has uniform thickness.

5. The wringing device of claim 1, further comprising a plurality of ribs at the under face.

6. The wringing device of claim 1, wherein each wall member includes at least one outwardly projecting rib.

7. The wringing device of claim 1, wherein the rib extends partially to the outer portion.

8. The wringing device of claim 1, wherein the rib extends partially to the inner portion.

9. The wringing device of claim 1, wherein the wall members are connected to one another at a base.

10. The wringing device of claim 1, wherein the outer portion of the wall members are connected to a housing.

11. The wringing device of claim 1, wherein the housing is removably connected to the container.

* * * * *